US008197750B2

(12) United States Patent
Trueeb et al.

(10) Patent No.: US 8,197,750 B2
(45) Date of Patent: Jun. 12, 2012

(54) LABORATORY DEVICE FOR PROCESSING SAMPLES AND METHODS USING THE SAME

(75) Inventors: Heinz Trueeb, Hochdorf (CH); Armin Birrer, Steinhausen (CH); Thomas Brauner, Zurich (CH)

(73) Assignee: Roche Molecular Systems, Inc., Pleasanton, CA (US)

( * ) Notice: Subject to any disclaimer, the term of this patent is extended or adjusted under 35 U.S.C. 154(b) by 361 days.

(21) Appl. No.: 12/355,683

(22) Filed: Jan. 16, 2009

(65) Prior Publication Data

US 2010/0021352 A1 Jan. 28, 2010

(30) Foreign Application Priority Data

Jan. 18, 2008 (EP) ..... 08000912

(51) Int. Cl.
*B01L 9/06* (2006.01)

(52) U.S. Cl. ..... 422/50; 422/68.1; 422/51; 422/52; 422/53; 422/62; 422/560; 422/561; 422/562; 422/563; 422/564; 343/701; 343/702; 343/895

(58) Field of Classification Search ..... 422/560, 422/561, 562, 563, 564, 50, 64, 61, 62, 63, 422/51, 52, 53; 343/700, 701, 702; 340/572.7, 340/540, 572.1
See application file for complete search history.

(56) References Cited

U.S. PATENT DOCUMENTS

| | | | | |
|---|---|---|---|---|
| 6,335,686 | B1 | 1/2002 | Goff et al. | |
| 6,598,796 | B2 * | 7/2003 | Harrop | 422/941 |
| 2002/0149521 | A1 * | 10/2002 | Hendler et al. | 343/895 |
| 2004/0070503 | A1 | 4/2004 | Monahan | |
| 2006/0039834 | A1 * | 2/2006 | Itoh | 422/104 |
| 2006/0213964 | A1 | 9/2006 | Excoffier et al. | |
| 2008/0129513 | A1 | 6/2008 | Bielas et al. | |

FOREIGN PATENT DOCUMENTS

| | | |
|---|---|---|
| EP | 08000912 | 6/2008 |

* cited by examiner

*Primary Examiner* — In Suk Bullock
*Assistant Examiner* — Sharon Pregler
(74) *Attorney, Agent, or Firm* — M. Reza Savari

(57) ABSTRACT

The invention relates to devices and methods for the identification of test tubes in a test tube rack using RFID technology.

13 Claims, 5 Drawing Sheets

LABORATORY DEVICE FOR PROCESSING SAMPLES AND METHODS USING THE SAME

CROSS-REFERENCES TO RELATED APPLICATION

The present application claims the benefit of EP Appl. No. 08 000 912.9 filed Jan. 18, 2008, the entire content of which is hereby incorporated herein by reference in entirety.

FIELD OF THE INVENTION

The present invention relates to the identification of test tubes in a test tube rack using RFID technology.

DESCRIPTION OF PRIOR ART

Laboratory devices are important work tools and systems in sample processing and laboratory analytics in the clinical area, chemical and pharmaceutical area, in immunology etc. Modern laboratory and analyser devices are conceived in a modular manner and provide for fully automated laboratory work. Different modules relate to different fields of analytics, using for example dispenser technology or pipette technology. Reagents and specimens used in the analytical work are usually provided in individual containers such as test tubes, wherein one or more reagent containers are placed in a reagent container carrier structure. Reagent container carrier structures are well-known in this field of technology under various terms such as racks, cassettes, cartridges etc. For ease of reference, all these holding devices will be referred to as test tube racks or just racks throughout this application. Further, the term test tube will be used as synonym for any kind of suitable container.

In the course of the analysing process, one or more test tube racks holding each at least one test tube are placed in a respective laboratory device. In order for the laboratory device to be able to treat the inserted carrier structure properly, i.e. identifying its content etc., each test tube usually comprises a barcode label on its outer surface. The laboratory device in turn comprises a barcode reader installed in such a manner that the barcode information contained on the label of the test tube can be read and transferred to a computing and control unit of the laboratory device.

With the advent of RFID technology in laboratory work, particularly for identification of reagent work probes, RFID assemblies on test tubes and other reagent containers have become more and more widespread.

Radio Frequency Identification (RFID) provides a convenient mechanism for identifying and detecting objects using wireless electromagnetic signals. A basic RFID system has at least one RFID reader and at least one RFID assembly (the latter also known by the term "transponder" or "RFID tag"). Typically, RFID readers can include a coil or antenna and circuitry to transmit and receive signals with the coil or antenna. An RFID assembly or tag or transponder also includes a coil or antenna and some information stored on an RFID chip that can be read by an RFID reader. It is known to the one skilled in the art that RFID antennas do not only take the form of coils (as depicted in FIG. 1 by ways of example) but can also be dipoles, e.g. in the UHF range for inductive coupling.

The RFID reader antenna generates an electromagnetic field, thereby transferring energy to the tag. The voltage transfer between the reader and tag coils is accomplished through inductive coupling between the two coils, i.e. the antenna coil of the reader and the antenna coil of the tag. As in a typical transformer, where a voltage in the primary coil transfers to the secondary coil, the voltage in the reader antenna coil is transferred to the tag antenna coil and vice versa. Depending on the design of the tag, a portion of the energy transferred to the tag will be reflected to the reader so as to provide information about the tag back to the reader. Information exchange may also be realised by means of a modulation of the electromagnetic field (instead of reflection). Some RFID systems can be used to read and optionally write data to and from the RFID tag. RFID readers can generate signals spanning distances from less than one centimeter to more than fifty meters depending on frequency and power of the signals generated at the RFID reader antenna.

Typically, RFID assemblies or tags are categorised as either active or passive. Active RFID tags are powered by an internal battery and are typically read/write, i.e. tag data can be rewritten and/or modified. An active tag's memory size varies according to application requirements, some systems operating with up to 1 MB of memory and more. Passive RFID tags operate without a separate external power source and obtain operating power generated from the reader. Passive tags are consequently typically lighter than active tags, less expensive, and offer a long operational lifetime. Passive tags typically have shorter read ranges than active tags and require a higher-powered reader. Read-only tags are typically passive and can be programmed with a unique set of data (usually 32 to 128 bits) that is typically predetermined at the time of manufacture of the tag. It is understood that passive read/write tags can also be employed consistent with the present teachings.

SUMMARY OF THE INVENTION

In an aspect, the invention relates to a laboratory device for processing samples, comprising a rack holding element for holding a test tube rack, and comprising an antenna structure element for wireless coupling with an RFID chip, the antenna structure element comprising a carrier with at least two antennas applied thereon, wherein the carrier is made of thin and flexible material such that by appropriate bending of the antenna structure element, the at least two antennas are brought in pairs into an angular position with each other, wherein the antenna structure element is positioned adjacent to the rack holding element in such a manner as to enable coupling with an RFID chip of a test tube rack being inserted into the rack holding element.

In another aspect, the invention relates to a test tube rack comprising at least one test tube receptacle capable of holding at least one test tube having an RFID assembly, and further comprising an antenna holding element for receiving and holding an antenna structure element for wireless coupling with an RFID chip, the antenna structure element comprising a carrier with at least two antennas applied thereon, wherein the carrier is made of thin and flexible material such that by appropriate bending of the antenna structure element, the at least two antennas are brought in pairs into an angular position with each other, and wherein the antenna holding element is shaped such that the antenna structure element held therein is bent so as to place the at least two antennas in pairs in an angular position to each other adjacent to the at least one test tube receptacle.

In a further aspect, the invention relates to a rack holding assembly comprising a rack holding element capable of holding a test tube rack, and comprising an antenna holding element capable of holding an antenna structure element for wireless coupling with an RFID chip, the antenna structure element comprising a carrier with at least two antennas applied thereon, wherein the carrier is made of thin and flexible material such that by appropriate bending of the antenna structure element, the at least two antennas are brought in pairs into an angular position with each other, wherein the antenna holding element is positioned adjacent to the rack holding element in such a manner as to enable coupling with an RFID chip of a test tube rack being inserted into the rack holding element.

In yet another aspect, the invention relates to a method for coupling an RFID chip in a laboratory device according to the invention by means of a pair of antennas, comprising the following steps of placing the RFID chip adjacent to the pair of antennas and subsequently or simultaneously energising each antenna of the pair of antennas.

In another aspect, the invention relates to an antenna structure element for wireless coupling with an RFID chip, the antenna structure element comprising a carrier with at least two antennas applied thereon, wherein the carrier is made of thin and flexible material effective for bringing the at least two antennas in pairs into an angular position with each other.

In another aspect, the invention relates to a laboratory device for processing samples, comprising a rack holding element capable of holding a test tube rack, and comprising an antenna structure element capable of wireless coupling with an RFID chip, the antenna structure element comprising a carrier with at least two antennas applied thereon, the carrier being made of thin and flexible material, wherein the antenna structure element is placed in an antenna holding element of the laboratory device in an appropriately bent manner such that the at least two antennas are placed in pairs into an angular position with each other, wherein the antenna structure element is positioned adjacent to the rack holding element in such a manner as to enable coupling with an RFID chip of a test tube rack being inserted into the rack holding element.

DETAILED DESCRIPTION OF THE INVENTION

Figure 1:
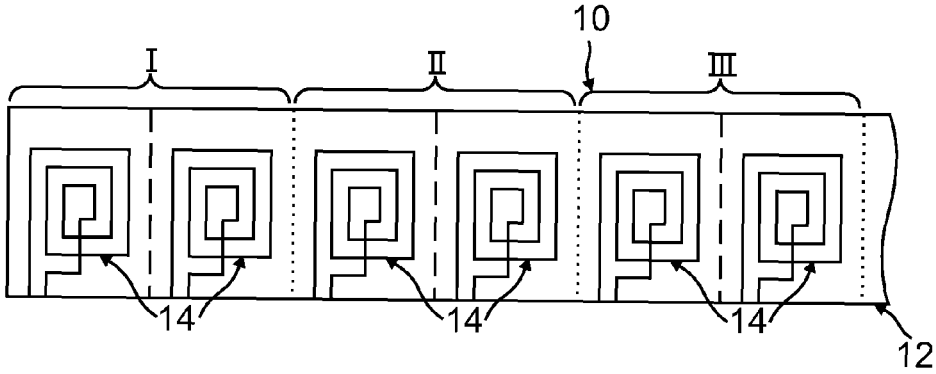
FIG. 1 shows a top view of an embodiment of an antenna structure element according to the invention.

The present invention relates to a laboratory device for processing samples comprising an antenna structure element for wireless coupling with an RFID chip, as well as a test tube rack and a rack holding assembly using such an antenna structure element. The present invention further relates to a method for coupling an RFID chip by means of a pair of antennas.

In one embodiment of the invention, a laboratory device for sample processing comprises a rack holding element for holding a test tube rack, an antenna structure element with a carrier with at least two antennas applied thereon. The total number of antennas applied on the carrier depends on the intended use of the antenna structure element. The carrier of the invention may be made of thin and flexible material, such as a plastic material foil, for example PVC or PE or PP or any other suitable material to which antennas or antenna coils can be attached. The carrier material should enable the carrier and the antenna layout on the carrier to be designed such that by appropriate bending of the antenna structure element, the at least two antennas are brought, as pairs, into an angular position with each other.

In another embodiment of the invention, an antenna structure element is provided which enables a user to arrange pairs of antennas at an angular position of his or her choice. The flexible carrier material is not limited to one given angle or a given range of angles, but can be bent or folded to adjust any angle between two adjacent antennas. Such an antenna element is easier to produce than known antenna elements, and mounting of the antenna element requires fewer assembly or mounting steps.

By appropriately choosing the carrier material, the bending may be reversible so that an adjusted angle can be readjusted. This enables multiple use of the antenna structure element of the invention. It is to be understood that the terms "angle" and "angular position" cover every angle from about 0° to about 180°.

There are a number of possible ways to apply the antennas to the carrier, such as printing, depositing, by lithographic techniques or by means of adhesion or other methods well known to the person skilled in the art. Possible materials for realizing the antennas, e.g. by printing, are copper or aluminum. However, any other electrically conducting material is suitable.

Another aspect of the invention relates to a rack holding assembly comprising a rack holding element for inserting a test tube rack, and further comprising an antenna holding element for receiving and holding an antenna structure element according to the invention, the antenna holding element being positioned adjacent to the rack holding element in such a manner as to enable coupling with an RFID chip of a rack being inserted into the rack holding element. Such a rack holding assembly may be integrated in a laboratory analyser device, and to allow RFID assemblies on test tube racks to be detected without the need for the test tube rack to be equipped with an antenna structure.

A further aspect of the invention covers a test tube rack comprising at least one test tube receptacle for receiving and holding at least one test tube, the test tube having an RFID assembly. The test tube rack according to the invention further comprises an antenna holding element, which is designed to receive and hold an antenna structure element according to the invention. This allows a test tube rack to be easily equipped with RFID reader antennas by just inserting an antenna structure element comprising two or more antennas into the test tube rack. In this manner it is possible to read data from or write data to the RFID assemblies on the test tubes in the test tube rack.

The antenna holding element may be shaped so as to create a desired positioning of the antennas. This also means that an antenna structure element can be placed in different test tube racks and have a different shape with different angles between pairs of antennas in each of the test tube racks.

The antenna holding element can be shaped to allow the inserted antenna structure element to be bent so as to place the at least two antennas in pairs in an angular position to each other. The antenna holding element can be, for example, saw tooth-shaped (i.e. zigzag-shaped) or meander-shaped (following a winding and turning course). In one embodiment, the antenna holding element can have a shape which results in two adjacent antennas lying flat next to each other, i.e. at an angle of about 180°. The antenna holding element may be, for example, an antenna receptacle.

In some embodiments of the invention, the angle between the at least two paired antennas is between about 0° and about 180°, or between about 60° and about 120°, or between about 80° and about 100°, or about 90°.

The method for coupling an RFID chip by means of a pair of antennas according to the invention comprises placing the RFID chip adjacent to the pair of antennas and energising each antenna of the pair of antennas, wherein energising is performed subsequently, alternatingly, or simultaneously. The type of energising desired can be determined by taking into account the signal quality of the signals received from the RFID chip.

Further features and embodiments will become apparent from the description and the accompanying drawings.

It will be understood that the features mentioned above and those described hereinafter can be used not only in the combination specified but also in other combinations or on their own, without departing from the scope of the present disclosure.

Various implementations are schematically illustrated in the drawings by means of an embodiment by way of example and are hereinafter explained in detail with reference to the drawings. It is understood that the description is in no way limiting on the scope of the present disclosure and is merely an illustration of a preferred embodiment. Wherever possible, the same reference numbers are used throughout the drawings to refer to the same or like parts.

Consequently, the terms "RFID assembly" or "RFID tag" as used herein refer to either an active or passive RFID tag that contains information. The RFID tag can be read only or read/write. The information associated with the RFID tag can be hard-coded into the RFID tag at the time of manufacture or at some later time, or the RFID tag can contain information that is written to the RFID tag throughout its lifetime.

The term "RFID reader" as used herein includes devices that can read information from and/or write information into an RFID tag. Typically, an RFID readers comprises an antenna subsystem and an RF interface for generating RF frequency, modulating the sender signal and receiving and de-modulating RF frequencies from the tag, as well as a control unit for controlling the communication and providing encoding/decoding. Application software for running the reader, i.e. the control unit, might be stored on a computer linked to the RFID reader, or on a microprocessor which forms part of the reader.

The term "information" as used herein refers to data that can be stored electronically in the RFID tag and can be retrieved to be used as machine readable or human readable data for processing the reagent or specimen and/or test tube and/or test tube rack and/or can be written to the RFID tag during or after processing. It covers but is not restricted to information such as type of reagent, specimen, lot size, donor, production or donation date, production or donation place, application data, system type suitability, use-by date, set point, control point, calibration data, laboratory device log data, date of first opening, used in which device, sampling data, carrier structure control data, and the like.

The term "test tube" as used herein refers to any kind of sample or reagent vessel as used in a medical or clinical laboratory, containing samples, reagents, cleansing liquids, buffer solutions etc. The term "laboratory device" as used herein refers to any kind of automated laboratory device able to process samples or reagents or the like, wherein the term "processing" covers any kind of handling, pipetting, cleansing, stirring, mixing, analysing, incubating etc. of laboratory samples, reagents, buffer solutions and the like.

It is to be noted that the term "antenna receptacle" comprises any sort of holding element which is suitable to hold an antenna structure element according to the invention in such a manner that the antenna will fulfil its function. For example, the receptacle could consist of a slot of an appropriate shape (like saw-tooth, meander etc.), or of a groove, or just of pins through which the flexible material of the antenna structure element could be inserted and held in place.

FIG. 1 shows in schematic manner a top view of an embodiment of an antenna structure element 10 of the present invention. The antenna structure element 10 has the form of a strip forming a carrier 12 on which a plurality of antennas 14 is applied. The carrier 12 may be made of thin and flexible material. The antennas 14 may be of any shape e.g. circular or formed as coils, with respective ends of the coils being used for connecting the antennas to a radio frequency source (not shown in FIG. 1).

In the embodiment of FIG. 1, the carrier 12 comprises six antennas 14. The antennas 14 are applied on the carrier 12 by means known to the person skilled in the art, such as, for example depositing, printing, adhesion, lithography etc.

Due to the flexibility of its material, the carrier 12 can be bent or folded. Folding or bending can occur along the lines indicated by dashes and dots in the depiction of FIG. 1, i.e. the carrier 12 may be bent towards the viewer of FIG. 1 along the dashed lines and/or may be bent away from the viewer of FIG. 1 along the dotted lines. This may result in a zigzag-shaped configuration, with pairs I, II, III of the antennas 14 being brought into an angular position with each other.

Figure 2:
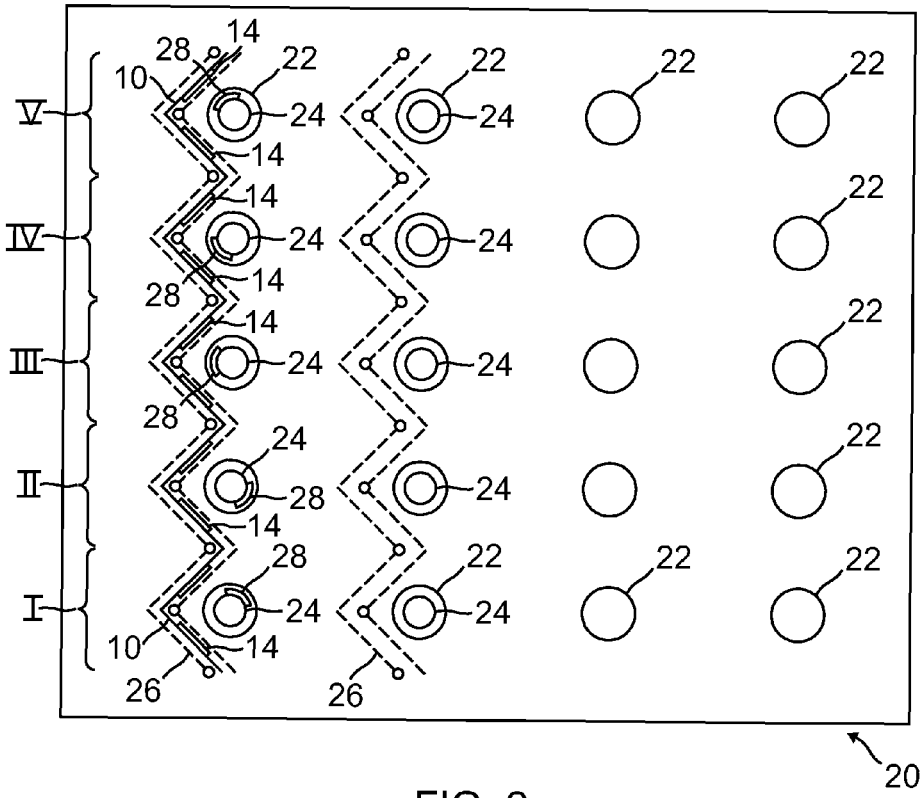
FIG. 2 shows a top view of an embodiment of a test tube rack according to the invention.

This can also be seen in the illustration of FIG. 2. FIG. 2 shows a test tube rack 20 according to the invention in schematic manner. The test tube rack 20 comprises a plurality of test tube receptacles 22. In the depiction of FIG. 2, the test tube rack 20 comprises four columns of five test tube receptacles 22. On FIG. 2, in the first two columns from the left each of the receptacles 22 is shown as containing a test tube 24.

The test tube rack 20 further may comprise antenna holding elements 26, such as receptacles, which in the depiction of FIG. 2 are shown in dashed lines. The antenna holding elements 26 may have a generally saw tooth-like form, and they can be formed as a recess with saw tooth-form in the bottom of the test tube rack 20. They could also be formed as a frame-like holder with supporting walls extending from the bottom of the test tube rack 20. Any other form and shape of the antenna holding elements or receptacles which allows inserting the antenna structure element to place pairs of antennas adjacent to a test tube are in conformity with the teaching of the invention.

In the depiction of FIG. 2, two antenna receptacles 26 are shown along the two left-most columns of test tube receptacles 24. The remaining antenna receptacles are omitted for the sake of clearness of the drawing. In the first antenna receptacle 26 from the left, an antenna structure element 10 according to the invention and as illustrated in FIG. 1 is placed. The second antenna receptacle 26 from the left is left empty in order to better show details.

The shape of the antenna receptacle 26 causes the antenna structure element 10 to be bent or folded in such a manner that the antennas 14 on the antenna structure element 10 are placed adjacent to respective test tubes 24 in the test tube receptacles 22 in pairs I, II, III, IV, V, each pair comprising two antennas 14 in angular position to each other. In the depiction of FIG. 2, the angle between neighbouring antennas is about 90°. It will be apparent to the person skilled in the art that any other angle smaller or larger than about 90° between two antennas also falls within the scope of the invention.

As illustrated in FIG. 2, the antenna receptacle 26 may comprise, at the turning points of the saw tooth or zigzag-form, deflection pins standing up from the bottom of the test tube rack 20 for facilitating insertion of the antenna structure element.

Each of the test tubes 24 comprises an RFID assembly 28 on its outer surface. The RFID assemblies 28 are schematically indicated by bold lines on the test tubes 24. The RFID assemblies are not further illustrated in detail, as their construction and design is well known to the person skilled in the art.

In operation, test tubes are placed in test tube receptacles randomly and not in a specifically oriented manner. This means that the RFID assemblies are also randomly oriented with view to the antennas. The antenna structure element and the test tube rack according to the invention allow an RFID assembly to be coupled for read/write purposes independently of the orientation of the RFID assembly, because one of the two antennas of each pair of antennas can provide for coupling of the RFID assembly with an adequate quality for reading writing. If one of the antennas is perpendicularly oriented to the RFID assembly, the respective other one of the pair of antennas is oriented in parallel (in case of an angle of about 90° between the two antennas) or in a low angle to the RFID assembly and thus can establish a good coupling with the RFID assembly. For reading/writing the two antennas of a pair of antennas are energised subsequently/alternatingly, with one of the two antennas providing a better quality coupling.

Figure 3:
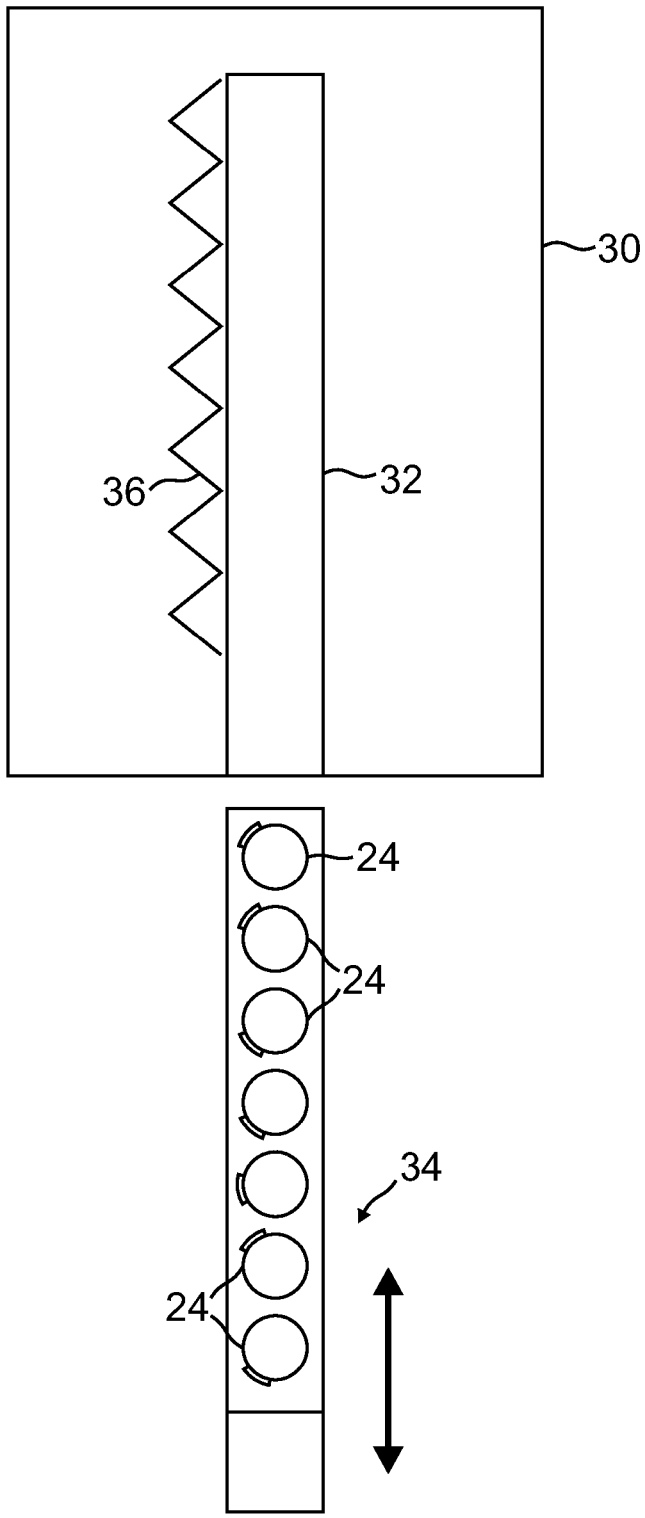
FIG. 3 shows a top view of an embodiment of a rack holding assembly according to the invention.

FIG. 3 shows a schematic top view of a rack holding assembly 30. The rack holding assembly can be integrated into a laboratory analyser device, for example as loading equipment for loading racks into the analyser.

The rack holding assembly 30 comprises a rack holding element 32 that is effective to hold an inserted test tube rack 34. In the case of the embodiment illustrated in FIG. 3, the rack holding element 32 is designed as a slot comprising the same outline dimensions as the inserted tube rack 34 to be inserted for sliding engagement of the rack in the slot. Other possible designs for the rack holding element, such as a guiding track, are known to those skilled in the art.

The rack holding element 32 further comprises an antenna receptacle 36 for receiving and holding an antenna structure element according to the invention and as described above. The antenna receptacle is designed in such a manner that the antenna structure element placed into the antenna receptacle lies adjacent to the inserted tube rack 34 when the latter is inserted into the rack holding element 32. Accordingly, and as explained above, the pair of antennas of the antenna structure element are able to couple with any RFID assemblies of the test tube rack 20 (be it RFID assemblies of the rack itself or RFID assemblies attached to test tubes in the test tube rack). Thus, although it is one embodiment, it is not necessary for the inserted tube rack 34 to comprise any antennas in order to read out the test tube data.

If the rack holding element 32 is designed as a guiding track, the coupling and reading out of the RFID assemblies can be performed while the rack 34 passes by the antenna structure element in the antenna receptacle 36. In some embodiments, the passing by of the rack 34 might be interrupted during the reading out process.

Figure 5:
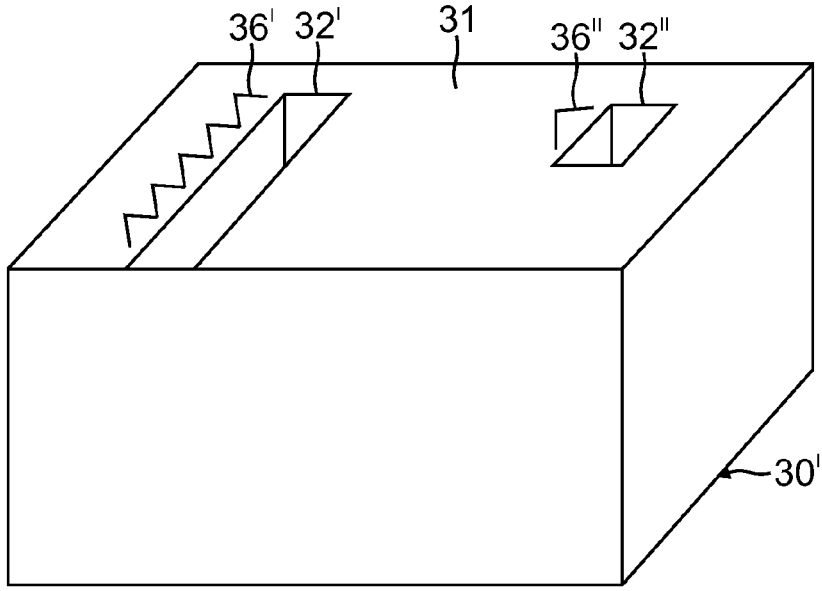
FIG. 5 shows a perspective view of a rack holding assembly according to the invention.

FIG. 5 shows another embodiment of a rack holding assembly 30' according to the invention. The rack holding assembly 30' of FIG. 5 is shown in perspective view, and has a box-like shape. On its top surface 31, the rack holding assembly 30' comprises a slot similar to the one of the embodiment shown in FIG. 3, which slot is a rack holding element 32'. In the case of the embodiment shown in FIG. 5, the rack holding element 32' has a toploader function, i.e. the rack (not shown) is inserted from above. Next to the slot 32' an antenna receptacle 36' like the one of FIG. 3 is shown.

Further in FIG. 5, the rack holding assembly 30' comprises, for illustrative purposes, an additional slot 32" of smaller dimensions. This additional slot also is a rack holding element 32" with toploader function, however for smaller racks holding only one single test tube. Accordingly, next to the second rack holding element 32", an antenna receptacle 36" is provided which can receive an antenna structure element with one pair of antennas thereon so that an RFID tag on one test tube can be coupled and read.

The embodiment illustrated in FIG. 5 can be an integral part of a laboratory device, or could be a stand-alone device connected to a larger laboratory device and/or computing/evaluation unit. It is to be understood that the embodiment illustrated in FIG. 5 is a highly schematic depiction in order to illustrate the different possibilities for the rack receiving slots (rack holding elements) and may take different and particularly more elaborate forms in reality.

It is also possible to energise both antennas of a pair of antennas in order to create a larger electromagnetic field and to enhance coupling. This is illustrated by way of example in FIG. 4.

Figure 4:
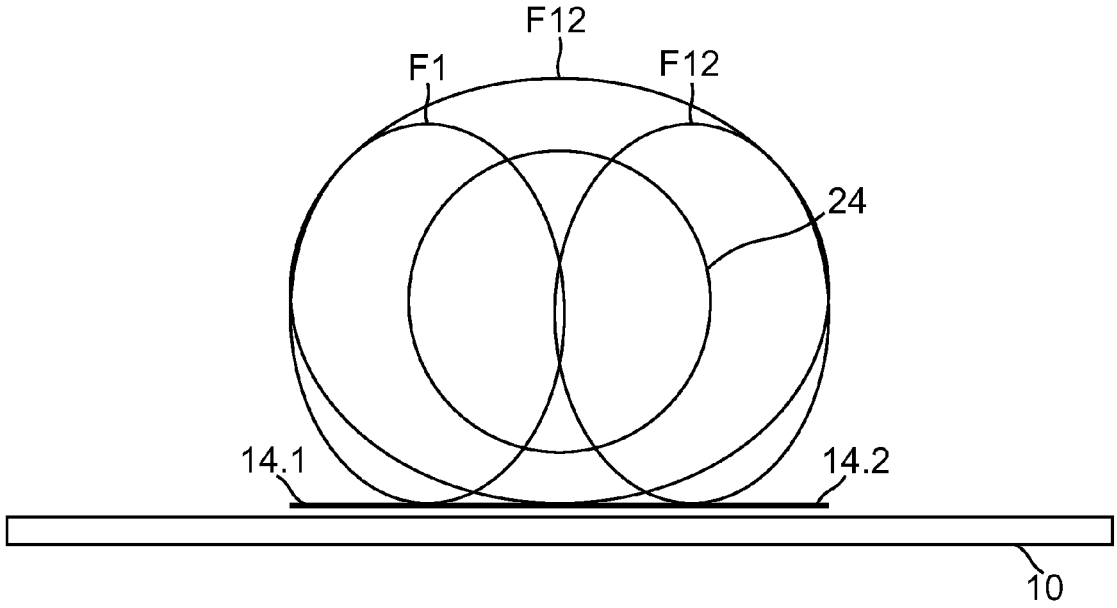
FIG. 4 shows a side view of another antenna structure element according to the invention with two antennas and their respective electromagnetic fields.

FIG. 4 shows a side (sectional) view of an antenna structure element 10 with a pair of antennas 14.1, 14.2 applied on the antenna structure element 10. The pair of antennas 14.1, 14.2 is placed adjacent to a test tube 24. If only the left one 14.1 of the two antennas is energised, the field depicted with reference sign F1 results. If only the right one 14.2 of the two antennas is energised, the field depicted with reference sign F2 results, and in case both antennas 14.1, 14.2 are energised, a combined larger field F12 results. Such a larger field F12 also facilitates coupling of RFID assemblies on test tubes in a test tube rack placed in a rack holding assembly as described above with reference to FIG. 3, particularly when the rack is moved in relation to the antenna irrespective of the orientation of the RFID assembly on the respective test tube.

It is to be noted that the "angle" between the pair of antennas 14.1, 14.2 in FIG. 4 is about 180°, i.e. that the two antennas lie flat next to each other and that there is "no angle" between them. This embodiment is also covered by the teaching of the invention. It is further to be noted that the realisation of a combined field also works in connection with pairs of antennas with an angle (as shown in FIG. 2). This would enable to coupling of RFID assemblies lying exactly between the two antennas (such as is illustrated in connection with the pair of antennas with reference sign III in FIG. 2). In these cases, subsequent energising of the antennas can be substituted by combined energising for optimum coupling.

Although certain embodiments of the invention have been described using specific terms, such description is for illustrative purposes only, and it is to be understood that changes and variations may be made without departing from the spirit or scope of the following claims.

While the foregoing invention has been described in some detail for purposes of clarity and understanding, it will be clear to one skilled in the art from a reading of this disclosure that various changes in form and detail can be made without departing from the true scope of the invention. For example, the methods and systems described above can be used in various combinations. All publications, patents, patent applications, and/or other documents cited in this application are incorporated by reference in their entirety for all purposes to the same extent as if each individual publication, patent, patent application, and/or other document were individually indicated to be incorporated by reference for all purposes.

What is claimed is:

1. A laboratory device for processing samples, comprising:

a rack holding element for holding an inserted tube rack designed to accommodate at least one test tube having an RFID chip attached thereon, and an antenna holding element holding an antenna structure element for wireless coupling with the RFID chip of the test tube, the antenna structure element comprising a carrier with at least two antennas applied thereon, wherein the carrier is made of thin and flexible material and the antenna structure element is held by the antenna holding element in a bent manner such that at least two antennas are brought in pairs into an angular position with each other, and wherein the antenna holding element is positioned adjacent to the rack holding element such that the RFID chip of the at least one test tube is flanked between the pair of two angled antennas while the inserted tube rack is inserted into the rack holding element, wherein the position of the antenna structure element enables coupling of the antennas with the RFID chip.

2. The laboratory device according to claim 1, wherein the antenna holding element forms part of the test tube rack.

3. The laboratory device according to claim 1, wherein the antenna holding element forms part of a rack holding assembly capable of receiving the test tube rack.

4. The laboratory device according to claim 1, wherein the at least two antennas of the antenna structure element are printed on the carrier.

5. The laboratory device according to claim 1, wherein the at least two antennas of the antenna structure element are deposited on the carrier.

6. The laboratory device according to claim 1, wherein the at least two antennas of the antenna structure element are adhered onto the carrier.

7. The laboratory device according to claim 1, wherein the at least two antennas of the antenna structure element comprise a material selected from the group consisting of copper and aluminum.

8. The laboratory device according to claim 1, wherein the at least two antennas of the antenna structure element are produced by a (photo-)lithography process.

9. The laboratory device according to claim 1, wherein the antenna holding element is an antenna receptacle.

10. The laboratory device according to claim 1, wherein the antenna holding element is saw tooth-shaped.

11. The laboratory device according to claim 1, wherein the angle between the at least two paired antennas is between about 0° and about 180°.

12. A rack holding assembly comprising:

a rack holding element for holding an inserted tube rack designed to accommodate at least one test tube having an RFID chip attached thereon, and an antenna holding element holding an antenna structure element for wireless coupling with the RFID chip of the test tube, the antenna structure element comprising a carrier with at least two antennas applied thereon, wherein the carrier is made of thin and flexible material and the antenna structure element is held by the antenna holding element in a bent manner such that at least two antennas are brought in pairs into an angular position with each other, and wherein the antenna holding element is positioned adjacent to the rack holding element such that the RFID chip of the at least one test tube is flanked between the pair of two angled antennas while the test inserted rack is inserted into the rack holding element, wherein the position of the antenna structure element enables coupling of the antennas with the RFID chip.

13. A laboratory device for processing samples, comprising:

a rack holding element holding an inserted tube rack designed to accommodate at least one test tube having an RFID chip attached thereon, and an antenna holding element holding an antenna structure element for wireless coupling with the RFID chip of the test tube, the antenna structure element comprising a carrier with at least two antennas applied thereon, the carrier being made of thin and flexible material and the antenna structure element being held by the antenna holding element in a bent manner such that at least two antennas are brought in pairs into an angular position with each other, wherein the antenna structure element is positioned adjacent to the rack holding element such that the RFID chip of the at least one test tube is flanked between the pair of two angled antennas while the inserted tube rack is inserted into the rack holding element, wherein the position of the antenna structure element enables coupling of the antennas with the RFID chip.

* * * * *